US009000685B2

(12) United States Patent
Cheng et al.

(10) Patent No.: US 9,000,685 B2
(45) Date of Patent: Apr. 7, 2015

(54) LIGHT EMITTING DEVICE POWER SUPPLY CIRCUIT, LIGHT EMITTING DEVICE CONTROL CIRCUIT AND IDENTIFIABLE LIGHT EMITTING DEVICE CIRCUIT THEREFOR AND IDENTIFICATION METHOD THEREOF

(71) Applicants: Chih-Tai Cheng, Taipei (TW); Chi-Hsiu Lin, Yunlin (TW); Pei-Yuan Chen, Zhubei (TW)

(72) Inventors: Chih-Tai Cheng, Taipei (TW); Chi-Hsiu Lin, Yunlin (TW); Pei-Yuan Chen, Zhubei (TW)

(73) Assignee: Richtek Technology Corporation, Zhubei, Hsinchu (TW)

( * ) Notice: Subject to any disclaimer, the term of this patent is extended or adjusted under 35 U.S.C. 154(b) by 0 days.

(21) Appl. No.: 14/158,806

(22) Filed: Jan. 18, 2014

(65) Prior Publication Data

US 2014/0203730 A1 Jul. 24, 2014

Related U.S. Application Data

(60) Provisional application No. 61/755,158, filed on Jan. 22, 2013.

(51) Int. Cl.
*H05B 37/02* (2006.01)
*H05B 33/08* (2006.01)

(52) U.S. Cl.
CPC ..... *H05B 33/0851* (2013.01); *H05B 33/0818* (2013.01)

(58) Field of Classification Search
USPC ..... 315/178, 307, 309, 224; 362/20
See application file for complete search history.

(56) References Cited

U.S. PATENT DOCUMENTS

| | | | | |
|---|---|---|---|---|
| 2010/0066270 | A1* | 3/2010 | Yang et al. | 315/309 |
| 2010/0134040 | A1* | 6/2010 | Elder | 315/294 |
| 2010/0208500 | A1* | 8/2010 | Yan et al. | 363/21.12 |
| 2011/0248637 | A1* | 10/2011 | Mitsuyasu et al. | 315/178 |
| 2013/0057240 | A1* | 3/2013 | Zambetti et al. | 323/271 |
| 2013/0069554 | A1* | 3/2013 | Kawata et al. | 315/224 |
| 2013/0113291 | A1* | 5/2013 | Recker et al. | 307/80 |
| 2013/0234532 | A1* | 9/2013 | Fells et al. | 307/104 |
| 2014/0015433 | A1* | 1/2014 | Kawata et al. | 315/210 |
| 2014/0203730 | A1* | 7/2014 | Cheng et al. | 315/297 |

* cited by examiner

*Primary Examiner* — Thuy Vinh Tran
*Assistant Examiner* — Syed M Kaiser
(74) *Attorney, Agent, or Firm* — Tung & Associates

(57) ABSTRACT

The present invention discloses a light emitting device power supply circuit, a light emitting device control circuit and an identifiable light emitting device circuit therefor, and an identification method thereof. The light emitting device control circuit includes an operation signal generation circuit and an identification circuit. The operation signal generation circuit determines whether the light emitting device control circuit operates in an identified mode or amiss mode according to an enable signal. In the identified mode, the light emitting device control circuit operates a power stage circuit to supply an output current to an identifiable light emitting device circuit. In the miss mode, an output voltage is maintained at a predetermined level. The identification circuit determines whether the light emitting device control circuit switches from the miss mode to the identified mode according to whether the output voltage meets a condition.

14 Claims, 7 Drawing Sheets

LIGHT EMITTING DEVICE POWER SUPPLY CIRCUIT, LIGHT EMITTING DEVICE CONTROL CIRCUIT AND IDENTIFIABLE LIGHT EMITTING DEVICE CIRCUIT THEREFOR AND IDENTIFICATION METHOD THEREOF

CROSS REFERENCE

The present invention claims priority to U.S. 61/755,158, filed on Jan. 22, 2013.

BACKGROUND OF THE INVENTION

1. Field of Invention

The present invention relates to a light emitting device power supply circuit, a light emitting device control circuit and an identifiable light emitting device circuit therefor, and an identification method thereof; particularly, it relates to such light emitting device power supply circuit, light emitting device control circuit and identifiable light emitting device circuit with an identification function, and an identification method thereof.

2. Description of Related Art

FIG. 1 shows a schematic diagram of a prior art light emitting diode (LED) power supply circuit 100. As shown in FIG. 1, the LED power supply circuit 100 supplies electrical power to an LED circuit 10. The LED power supply circuit 100 includes a control circuit 110, a power stage circuit 120, and a feedback circuit 130. The control circuit 110 is connected to the feedback circuit 130 to receive a feedback signal FB. The control circuit 110 generates an operation signal GATE according to the feedback signal FB, to operate a power switch of the power stage circuit 120 accordingly such that an input voltage Vin is converted to an output voltage Vout, and an output current Iout is provided to the LED circuit 10. The power stage circuit 120 may be a synchronous or asynchronous buck, boost, inverting, buck-boost, or inverting-boost power stage circuit as shown in FIGS. 2A-2J.

A hot swapping protection function is required for the prior art. "Hot swapping" means to remove an old LED circuit 10 from the circuitry and install a new LED circuit 10 while the power is still ON. In this prior art, when the old LED circuit 10 is removed, the feedback circuit 130 cannot obtain correct information to generate a correct feedback signal FB, and therefore the output voltage Vout is uncontrolled which may cause danger. Besides, whether the new LED circuit 10 can comply with the power supply specification of the LED power supply circuit 100 is unknown and it should preferably be confirmed, so as to maintain the stability of the LED power supply circuit 100 while it operates. The aforementioned prior art can not comply with the aforementioned requirements.

In view of above, the present invention proposes a light emitting device power supply circuit, a light emitting device control circuit and an identifiable light emitting device circuit therefor, and an identification method thereof which provide the hot-swapping protection function and optimize of the cooperation between the light emitting device power supply circuit and the identifiable light emitting device circuit.

SUMMARY OF THE INVENTION

From one perspective, the present invention provides a light emitting device power supply circuit, for identifying an identifiable light emitting device circuit to determine whether to operate in an identified mode or a miss mode and supply an output current to the identifiable light emitting device circuit in the identified mode, wherein the identified mode indicates that the identifiable light emitting device circuit is normally coupled to the light emitting device power supply circuit, and the miss mode indicates that the identifiable light emitting device circuit is not normally coupled to the light emitting device power supply circuit, the light emitting device power supply circuit comprising: a power stage circuit, for operating at least one power switch therein according to an operation signal in the identified mode, to convert an input voltage to an output voltage, and supply the output current to the identifiable light emitting device circuit; a level control circuit, for controlling the output voltage at a predetermined level in the miss mode; an identification circuit, for determining whether the miss mode is changed to the identified mode according to whether the output voltage meets a predetermined condition, and generating an enable signal correspondingly; and an operation signal generation circuit, for generating the operation signal according to a feedback signal when the enable signal indicates the identified mode.

In one preferable embodiment, the level control circuit includes a voltage divider circuit, the voltage divider circuit including a first bias circuit and a second bias circuit connected in series, wherein a connection node between the first bias circuit and the second bias circuit is electrically connected to the output voltage.

In one preferable embodiment, the identification circuit generates the enable signal after a delay time period from when the output voltage meets the predetermined condition.

In one preferable embodiment, a level of the output voltage changes while the identifiable light emitting device circuit changes from being not normally coupled to being normally coupled.

In one preferable embodiment, the predetermined condition is: the output voltage being lower than a reference level, and the reference level being lower than the predetermined level.

In one preferable embodiment, the identification circuit includes: a first comparison circuit, for generating a first comparison signal according to the output voltage and a first reference level, wherein the first reference level is higher than the predetermined level; a second comparison circuit, for generating a second comparison signal according to the output voltage and a second reference level, wherein the second reference level is lower than the predetermined level; and a determination circuit, which is coupled to the first comparison circuit and the second comparison circuit, and outputs the enable signal, wherein the determination circuit determines a level of the enable signal according to the first comparison signal and/or the second comparison signal.

From another perspective, the present invention provides a light emitting device control circuit, for identifying an identifiable light emitting device circuit to determine whether to operate in an identified mode or a miss mode, the light emitting device control circuit comprising: an operation signal generation circuit, for generating an operation signal according to a feedback signal in the identified mode to operate at least one power switch in a power stage circuit, such that an input voltage is converted to an output voltage and an output current is supplied to the identifiable light emitting device circuit; and an identification circuit, which is coupled to the operation signal generation circuit, for determining whether the miss mode is changed to the identified mode according to whether the output voltage meets a predetermined condition, and correspondingly generating an enable signal which is sent to the operation signal generation circuit, such that the light emitting device control circuit operates in the identified mode; wherein the identified mode indicates that the identifiable light emitting device circuit is normally coupled to the light emitting device power supply circuit, and the miss mode indicates that the identifiable light emitting device circuit is not normally coupled to the light emitting device power supply circuit, and wherein the output voltage is controlled at a predetermined level in the miss mode.

From another perspective, the present invention provides an identifiable light emitting device circuit for a light emitting device control circuit, wherein the light emitting device control circuit is for identifying the identifiable light emitting device circuit to determine whether to operate in an identified mode or a miss mode, such that in the identified mode, the light emitting device control circuit operates at least one power switch in a power stage circuit to convert an input voltage to an output voltage and supply an output current to the identifiable light emitting device circuit, and in the miss mode, the output voltage is controlled at a predetermined level, wherein the identified mode indicates that the identifiable light emitting device circuit is normally coupled to the light emitting device power supply circuit, and the miss mode indicates that the identifiable light emitting device circuit is not normally coupled to the light emitting device power supply circuit, the identifiable light emitting device circuit comprising: at least one light emitting device, for coupling to the power stage circuit and lighting by receiving the output current in the identified mode; and a passive device circuit, which is coupled to the light emitting device, for providing an impedance such that the output voltage is changed when the miss mode is changed to the identified mode, whereby the light emitting device control circuit determines that the identifiable light emitting device circuit is normally coupled to the light emitting device power supply circuit.

From another perspective, the present invention provides an identification method of identifying an identifiable light emitting device circuit, including: controlling an output voltage at a predetermined level when the identifiable light emitting device circuit is not normally coupled to the output voltage; providing an impedance in the identifiable light emitting device circuit; setting the output voltage to a predetermined condition by the impedance in the identifiable light emitting device circuit when the identifiable light emitting device circuit changes from being not normally coupled to being normally coupled to the output voltage; and determining whether the identifiable light emitting device circuit changes from being not normally coupled to being normally coupled according to whether the output voltage meets the predetermined condition.

In one preferable embodiment, the identification method further includes: delaying a delay time period after determining the identifiable light emitting device circuit changing from being not normally coupled to being normally coupled, and after the delay time period, enabling a power stage circuit to supply an output current to the identifiable light emitting device circuit.

In one preferable embodiment, the identification method further includes: determining that the identifiable light emitting device circuit changes from being normally coupled to being not normally coupled when the output voltage is lower than a first reference level, wherein the first reference level is higher than the predetermined level.

In one preferable embodiment, the predetermined condition is: the output voltage being lower than a second reference level, and the second reference level being lower than the predetermined level.

In one preferable embodiment, the step of controlling an output voltage at a predetermined level when the identifiable light emitting device circuit is not normally coupled to the output voltage includes: providing a voltage divider circuit which generates a divided voltage according to a supply voltage, and providing the divided voltage as the output voltage.

In one preferable embodiment, when the identifiable light emitting device circuit changes from being not normally coupled to being normally coupled, the impedance in the identifiable light emitting device circuit changes the divided voltage of the voltage divider circuit, such that the output voltage meets the predetermined condition.

The objectives, technical details, features, and effects of the present invention will be better understood with regard to the detailed description of the embodiments below.

DESCRIPTION OF THE PREFERRED EMBODIMENTS

Figure 1:
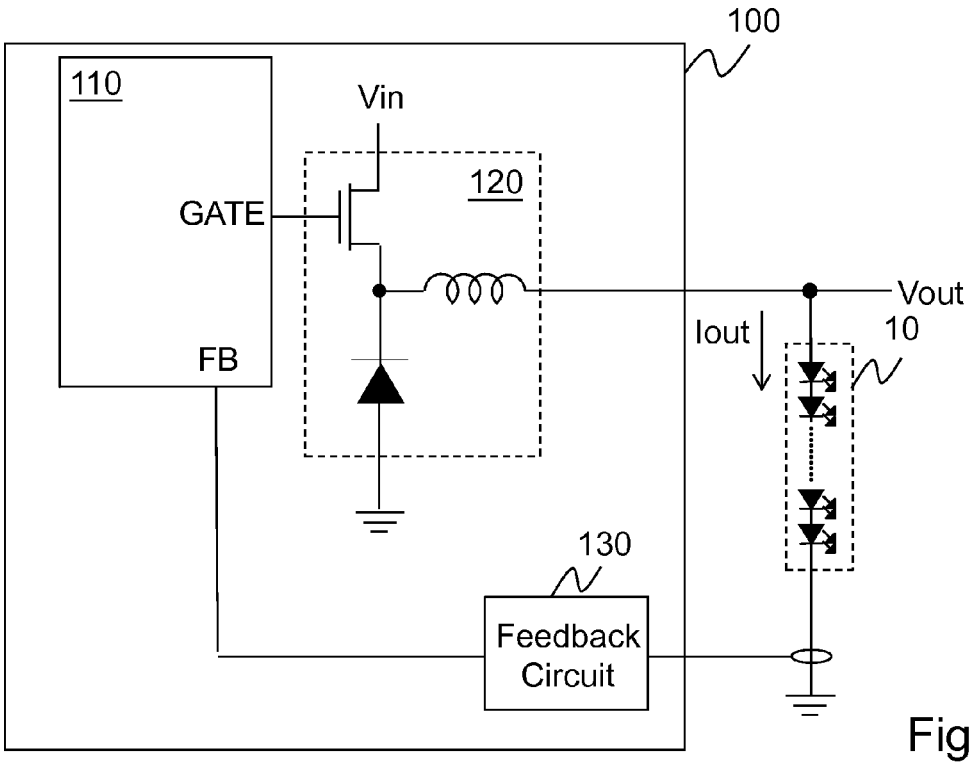
Fig. 1 (Prior Art)
FIG. 1 shows a schematic diagram of a prior art light emitting diode (LED) power supply circuit 100.
Figure 2A:
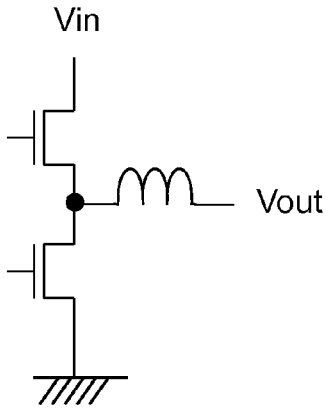
FIGS. 2A-2J show synchronous and asynchronous buck, boost, inverting, buck-boost, and inverting-boost power stage circuits.
Figure 2B:
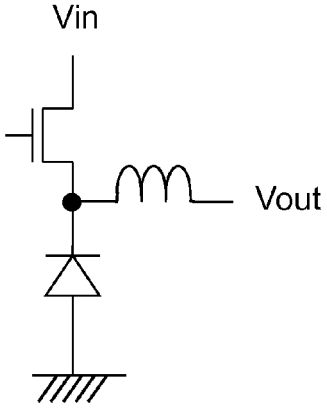
Figure 2C:
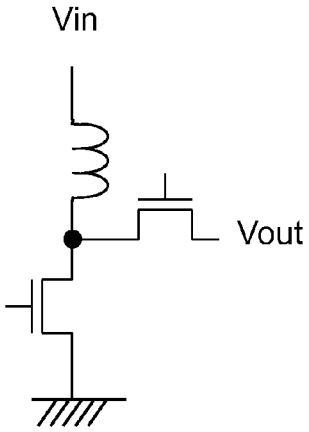
Figure 2D:
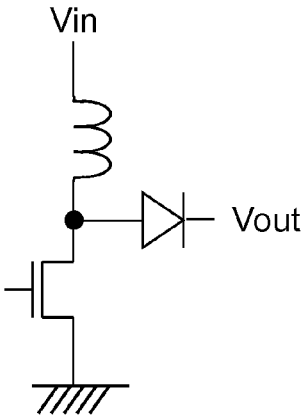
Figure 2E:
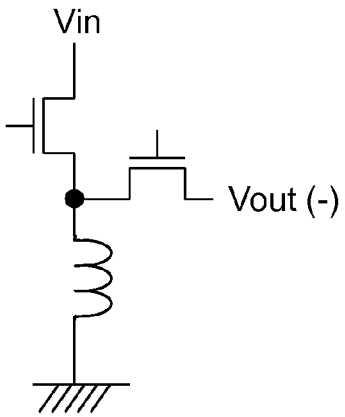
Figure 2F:
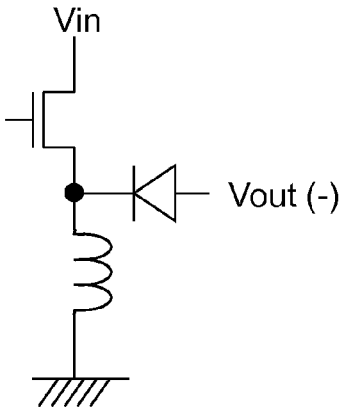
Figure 2G:
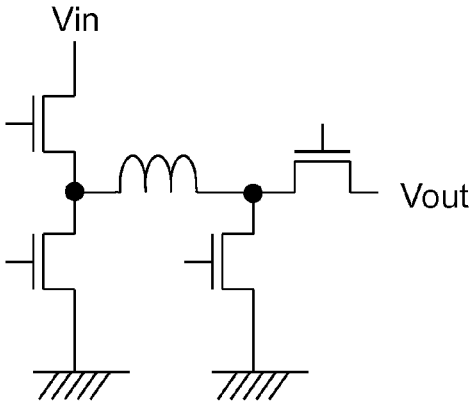
Figure 2H:
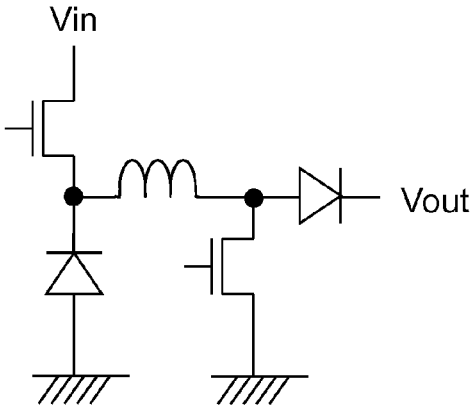
Figure 2I:
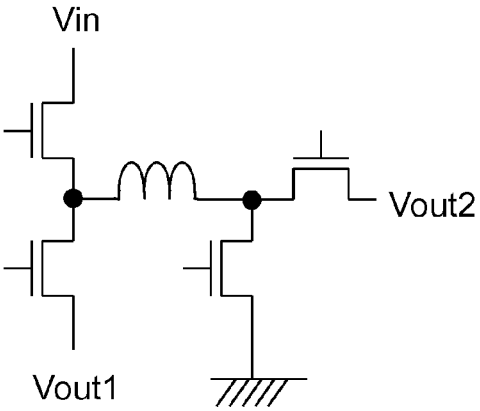
Figure 2J:
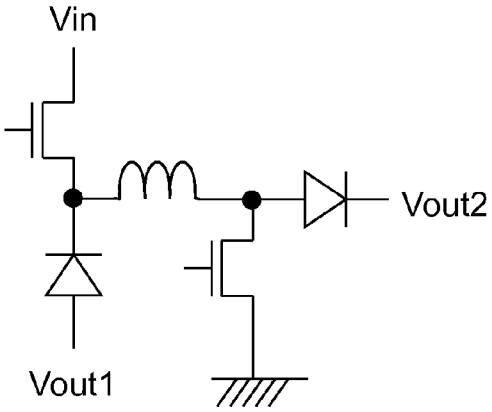
Figure 3:
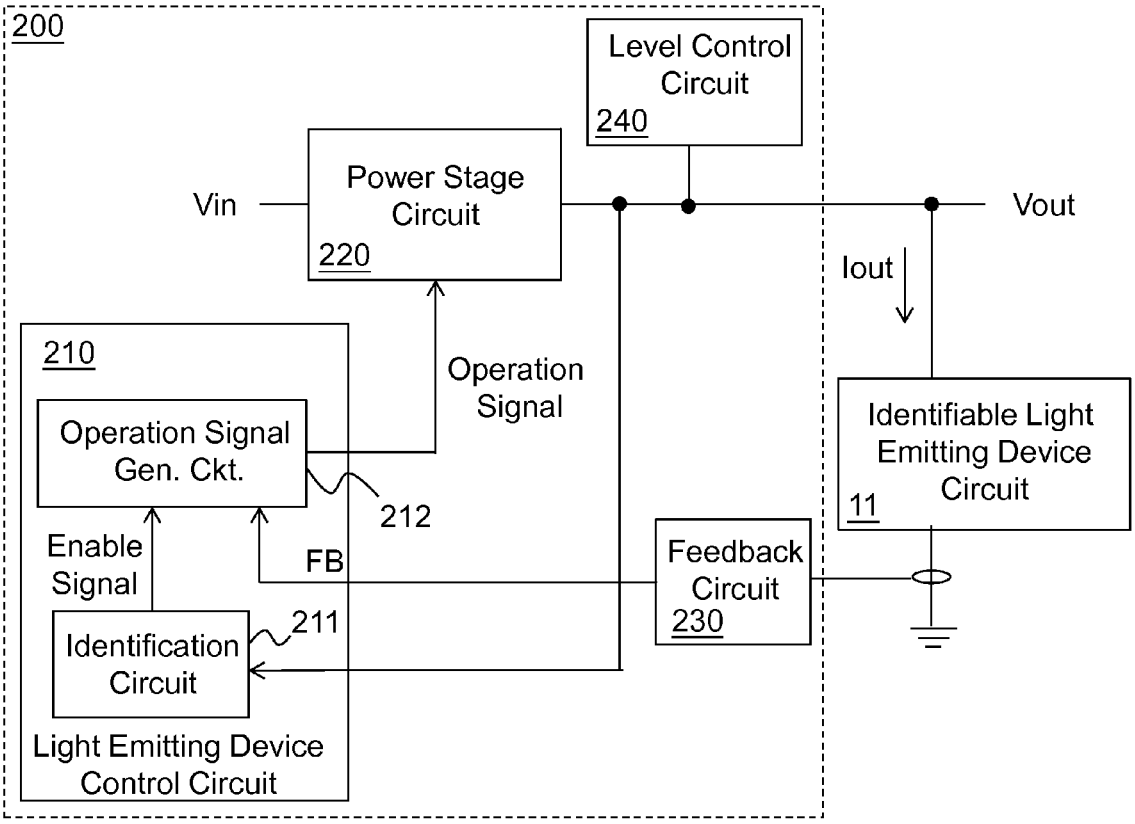
FIG. 3 shows a first embodiment the present invention.

Please refer to FIG. 3 for a first embodiment according to the present invention. As shown in FIG. 3, a light emitting device power supply circuit 200 includes a light emitting device control circuit 210, a power stage circuit 220, a feedback circuit 230, and a level control circuit 240. In a normal operation mode (also referred to as an "identified mode" in later description), the light emitting device control circuit 210 generates an operation signal according to a feedback signal FB, to operate at least one power switch (not shown in FIG. 3, referring to FIGS. 2A-2J) of the power stage circuit 220, such that an input voltage Vin is converted to an output voltage Vout and an output current Iout is supplied to an identifiable light emitting device circuit 11. The feedback circuit 230 generates the feedback signal FB according to the output current Iout flowing through the identifiable light emitting device circuit 11. The output current Iout is regulated at a predetermined current by feedback control. The power stage circuit 220 is for example but not limited to the synchronous or asynchronous buck, boost, inverting, buck-boost, or inverting-boost power stage circuit as shown in FIGS. 2A-2J. The identifiable light emitting device circuit 11 includes for example but not limited to a passive device circuit and a single LED string, or a passive device circuit and an LED array consisting of plural LED strings connected in parallel. The identifiable light emitting device circuit 11 will be described in detail later.

Still referring to FIG. 3, the light emitting device control circuit 210 includes an identification circuit 211 and an operation signal generation circuit 212. The identification circuit 211 determines whether or not a light emitting device circuit which meets a predetermined specification (such as the identifiable light emitting device circuit 11) is normally coupled, and correspondingly generates an enable signal which is sent to the operation signal generation circuit 212, such that the light emitting device control circuit 210 operates in the identified mode or a miss mode accordingly. The identified mode indicates that the identifiable light emitting device circuit 11 is normally coupled to an output node of the power stage circuit 220; the miss mode indicates that the identifiable light emitting device circuit 11 is not normally coupled to the output node of the power stage circuit 220 (e.g., there is no light emitting device circuit coupled to the output node, or there is alight emitting device circuit coupled to the output node but the light emitting device circuit does not meet the predetermined specification). Note that, in the context of this invention, that "the identifiable light emitting device circuit 11 is normally coupled to the output node" is equivalent to that "the identifiable light emitting device circuit 11 is normally coupled to the light emitting device power supply circuit 200" or that "the identifiable light emitting device circuit 11 is normally coupled to the output voltage Vout". In the identified mode, the enable signal enables the operation signal generation circuit 212 to generate the operation signal according to the feedback signal FB, so as to operate at least one power switch in the power stage circuit 220 to convert the input voltage Vin to the output voltage Vout and supply the output current Iout to the identifiable light emitting device circuit 11. In the miss mode, the enable signal disables the operation signal generation circuit 212. When the operation signal generation circuit 212 is disabled, the power stage circuit 220 is inactive, so the output voltage Vout is not regulated by the power stage circuit 220; under such circumstance, but the output voltage Vout is controlled by the level control circuit 240. The level control circuit 240 controls the output voltage Vout at a predetermined level. Because the output voltage Vout is controlled at the predetermined level which is safe, a user will not be injured and the circuitry will not be damaged during the hot-swapping process.

Figure 4A:
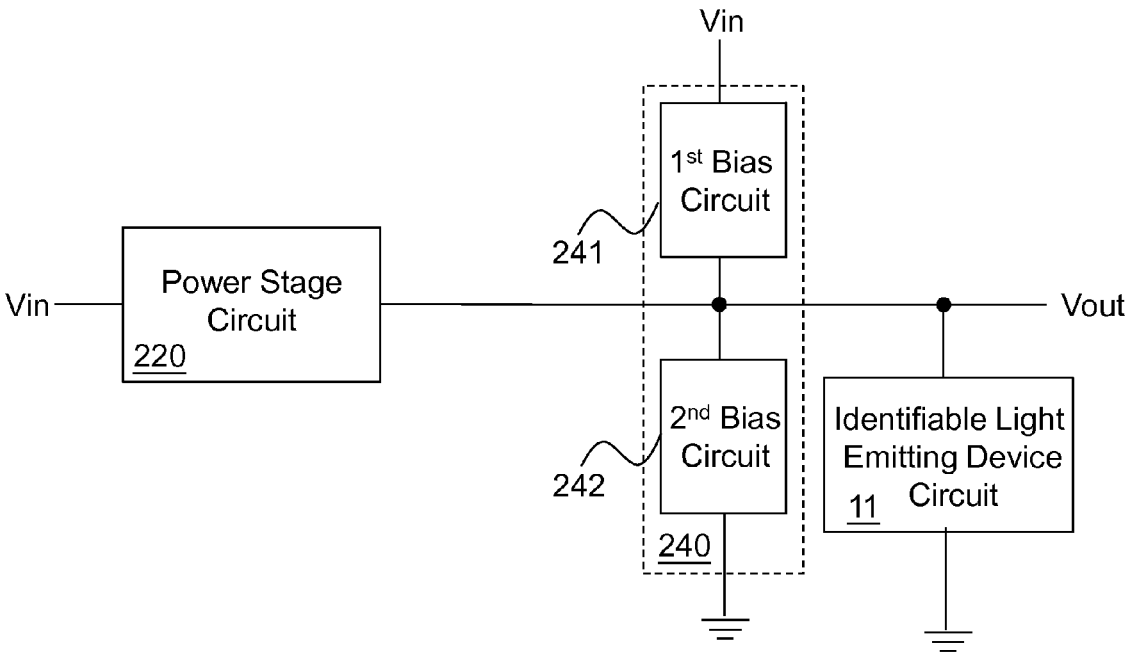
FIG. 4A shows an embodiment of a level control circuit of the present invention.

The level control circuit 240 can be embodied in various ways. One simple form is as shown in FIG. 4A. In the embodiment shown in FIG. 4A, the level control circuit 240 includes for example but not limited to a voltage divider circuit which includes a first bias circuit 241 and a second bias circuit 242, wherein the first bias circuit 241 for example has an equivalent impedance Z1, and the second bias circuit 242 for example has an equivalent impedance Z2. The level control circuit 240 may be connected to any proper voltage supply, such as the input voltage Vin in the shown embodiment. A connection node between the first bias circuit 241 and the second bias circuit 242 is electrically connected to the output voltage Vout. In the miss mode, the level control circuit 240 controls the output voltage Vout at the safe predetermined level, that is:

$$Vout=Vin*[Z2/(Z1+Z2)]$$

Note that the level control circuit 240 is not limited to the aforementioned embodiment. Besides, to provide protection function during the hot-swapping process, disabling the operation signal generation circuit 212 to deactivate the power stage circuit 220 and controlling the output voltage by the level control circuit 240 is only one of the methods. There are various ways to embody the protection function. For example, during the hot-swapping process, the operation signal generation circuit 212 and the power stage circuit 220 may keep operating, and the output voltage Vout is regulated at a safe level to achieve the protection function (referring to an embodiment described later and shown in FIG. 7).

The identification circuit 211 is for determining whether a light emitting device circuit which meets the specification is coupled to the output node of the power stage circuit 220. In a preferable embodiment, the identification circuit 211 determines whether the operation mode changes from the miss mode to the identified mode according to whether the output voltage Vout meets a predetermined condition (to be described in detail later), and generates a corresponding enable signal to control the operation signal generation circuit 212 ("generating a corresponding enable signal" may also be described as "determining a level of the enable signal"). One objective of the present invention is to identify the identifiable light emitting device circuit by the identification circuit, such that an unidentified light emitting device circuit can be excluded by the light emitting device control circuit to optimize the cooperation of the circuitry.

Figure 4B:
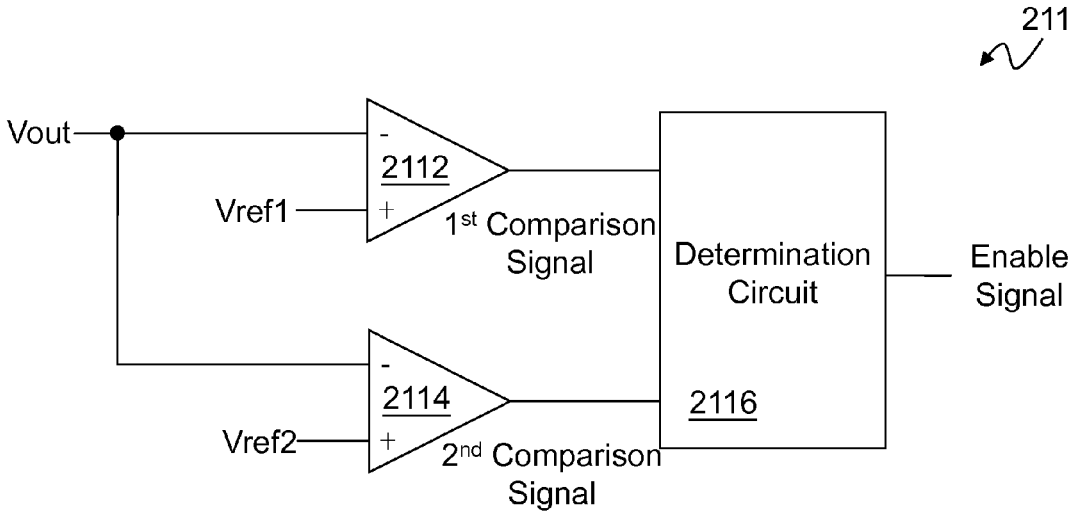
FIG. 4B shows an embodiment of an identification circuit of the present invention.

FIG. 4B shows a more specific embodiment of the identification circuit 211 according to the present invention. As shown in FIG. 4B, the identification circuit 211 includes comparison circuits 2112 and 2114, and a determination circuit 2116. The comparison circuit 2112 compares the output voltage Vout with a reference level Vref1 to generate a first comparison signal. The comparison circuit 2114 compares the output voltage Vout with a reference level Vref2 to generate a second comparison signal. In the shown embodiment, the comparison circuits 2112 and 2114 receive the output voltage Vout, but the present invention is not limited to this arrangement. The comparison circuits 2112 and 2114 may receive a signal which is related to the output voltage Vout, such as a divided voltage of the output voltage Vout. The determination circuit 2116 is coupled to the comparison circuits 2112 and 2114, and determines the level of the enable signal according to the first comparison signal and/or the second comparison signal. In one preferable embodiment, the identification circuit 2116 generates the enable signal after a delay time period from when the output voltage meets the predetermined condition (according to the first comparison signal and/or the second comparison signal), to ensure that the identifiable light emitting device circuit has been installed before the power stage circuit 220 resumes operating.

Figure 5:
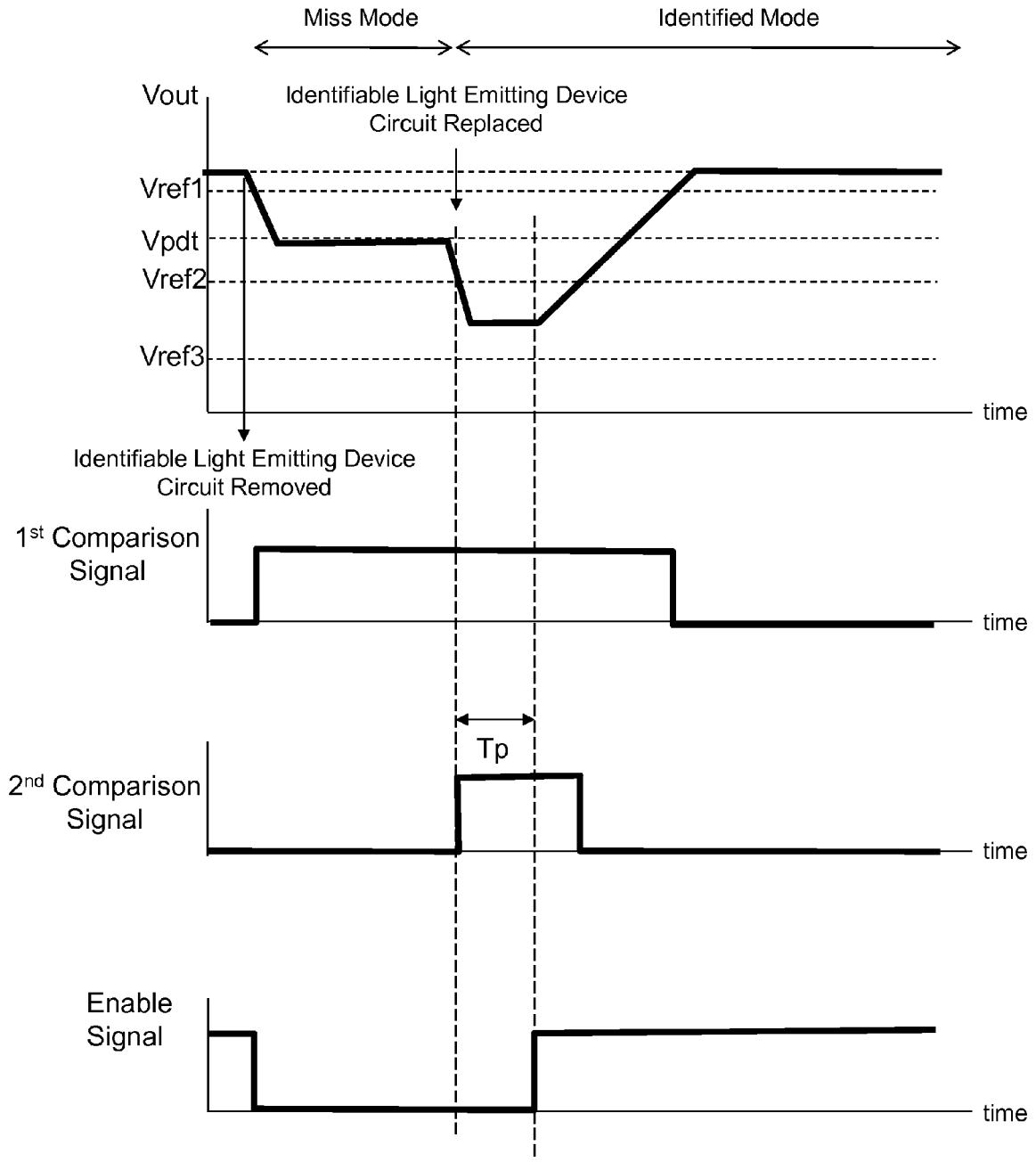
FIG. 5 shows signal waveforms of an output voltage Vout, a first comparison signal, a second comparison signal, and an enable signal in an embodiment.
Figure 6A:
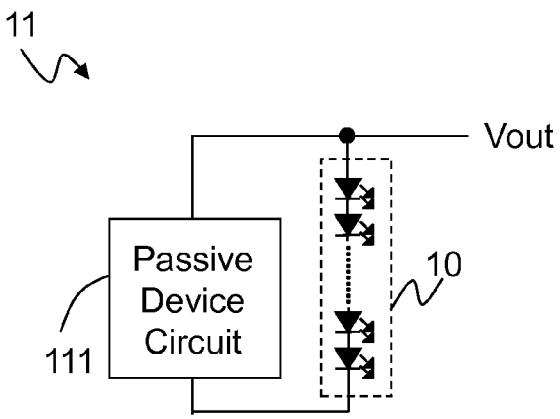
FIGS. 6A-6D show several embodiments of an identifiable light emitting device circuit of the present invention.
Figure 6B:
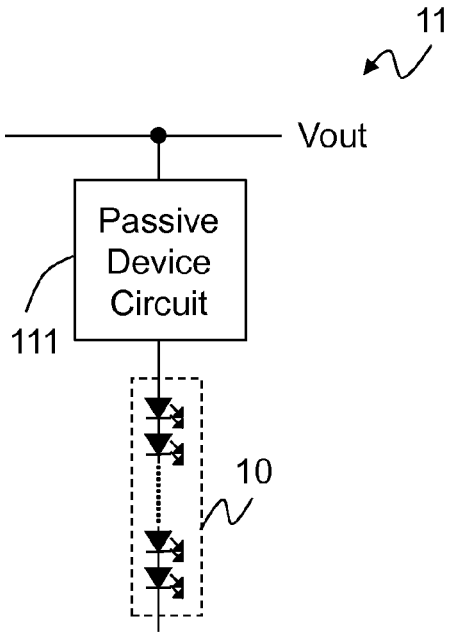
Figure 6C:
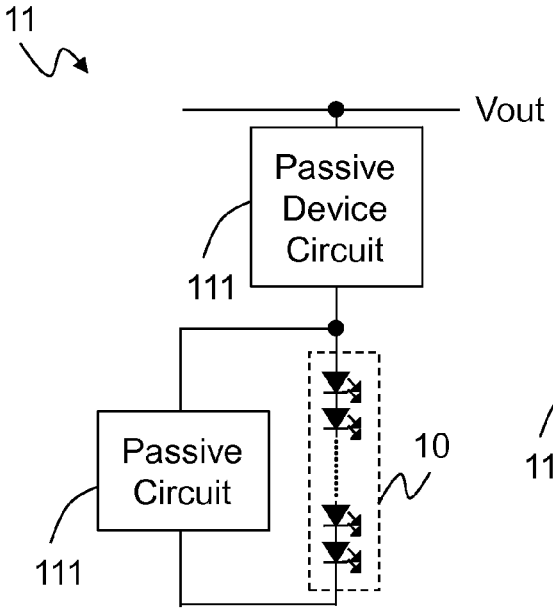
Figure 6D:
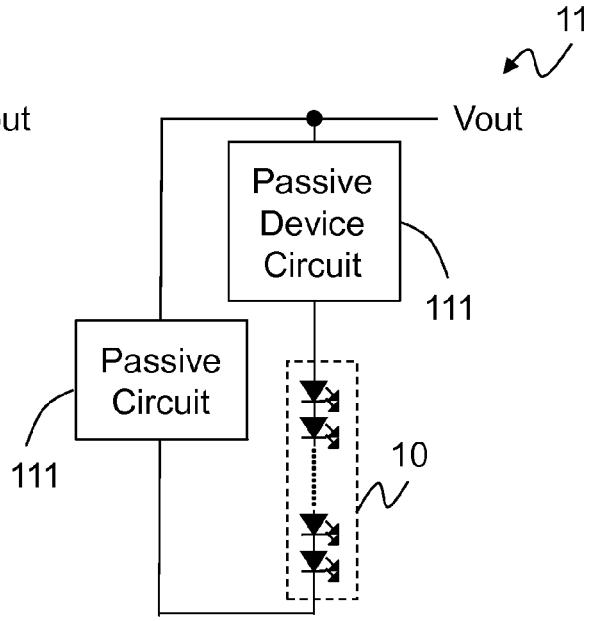

FIG. 5 shows schematic signal waveforms of the embodiment shown in FIG. 4B. As shown in FIG. 5, in the miss mode (indicating that the output node of the power stage circuit 220 is not coupled to an identifiable light emitting device circuit, for example, an identifiable light emitting device circuit which was installed is now removed), the enable signal is changed to a low level. Whether the enable signal should be changed to a low level can be determined according to any proper criteria, for example but not limited to: checking whether the output voltage Vout is lower than the reference level Vref1. In the miss mode, the output voltage Vout is controlled at a safe predetermined level Vpdt. Referring to FIG. 4A, when a new identifiable light emitting device circuit 11 is installed, because the identifiable light emitting device circuit 11 is connected to the second bias circuit 242 in parallel, the total impedance reduces, and a level of a connection node between the first bias circuit 241 and the second bias circuit 242 (i.e., the output voltage Vout) correspondingly drops. Referring to FIG. 4B, with proper settings of the reference level Vref2 and the impedance of the identifiable light emitting device circuit 11, when the identifiable light emitting device circuit 11 is installed, the output voltage Vout is lower than the reference level Vref2 (i.e., the output voltage meeting "the predetermined condition"), whereby it can be determined whether the installed light emitting device circuit is the light emitting device circuit which can comply with the required specification. On the other hand, when a light emitting device circuit is installed but the output voltage Vout is not lower than the reference level Vref2, it can be determined that the installed light emitting device circuit does not comply with the required specification.

In one embodiment, when the output voltage Vout is lower than the reference level Vref2, indicating that the installed identifiable light emitting device circuit 11 complies with the required specification, the identification circuit 211 generates the enable signal to enable the operation signal generation circuit 212. In another embodiment as shown in FIG. 4B, when the output voltage Vout is lower than the reference level Vref2, the identification circuit 211 does not immediately generate the enable signal, but delays a delay time period Tp, and afterward generates the enable signal to enable the operation signal generation circuit 212. In one hand, delaying the delay time period Tp can ensure safety (to prevent the power stage circuit 220 from resuming operation too fast to cause danger to a user changing the light emitting device circuit); on the other hand, delaying the delay time period Tp can confirm that the output voltage Vout is indeed lower than the reference level Vref2 to avoid misoperation (for example, a fluctuation of the input voltage Vin may cause the output voltage Vout to be lower than the reference level Vref2 for a short instant, and triggers the identification circuit 211 to generate the enable signal; such misoperation should be excluded). The determination circuit 2116 can include for example but not limited to a timer circuit or a differential circuit to count the delay time period Tp.

Note that the embodiment shown in FIGS. 4B and 5 is only one preferable embodiment showing a structure and an operation method of the identification circuit 211, and the present invention is not limited to this embodiment. For example, the identification circuit 211 may further include a third comparison circuit (not shown), to determine whether the output voltage Vout is not only lower than the reference level Vref2 but also higher than another reference level Vref3, wherein Vref3<Vref2. When the output voltage Vout meets this condition, indicating that the identifiable light emitting device circuit 11 which complies with the required specification is installed (in this embodiment, Vref3<Vout<Vref2 is the predetermined condition for the output voltage Vout), the identification circuit 211 generates the enable signal to enable the operation signal generation circuit 212. In another embodiment, the identification circuit 211 may generate the enable signal to enable the operation signal generation circuit 212 immediately instead of delaying a delay time period Tp.

The identifiable light emitting device circuit 11 preferably has a proper impedance to match the identification function of the identification circuit 211. In one preferable embodiment, the identifiable light emitting device circuit 11 includes a passive device circuit, which has an equivalent impedance such that the output voltage Vout is changed when the identifiable light emitting device circuit 11 is installed, wherein the change of the output voltage Vout can be identified by the identification circuit.

FIGS. 6A-6D show several more specific embodiments of the identifiable light emitting device circuit 11 with proper impedance according to the present invention. In these four embodiments, the identifiable light emitting device circuit 11 includes for example but not limited to the LED circuit 10 and a passive device circuit 111. The LED circuit 10 includes for example but not limited to plural light emitting devices, such as an LED string as shown in the figure; in another embodiment, the LED circuit 10 may include an array of plural light emitting device strings in parallel. The LED circuit 10 is for coupling to the power stage circuit 220, and in the identified mode, the LED circuit 10 lights by receiving the output current Iout. The passive device circuit 111 is coupled to the LED circuit 10, for providing an equivalent impedance, such that the identification circuit 211 can perform the identification function. As shown in FIGS. 6A-6D, the passive device circuit 111 may be coupled to the LED circuit 10 in series, in parallel, in series and then in parallel, or in parallel and then in series, etc. To provide the passive device circuit 111 in the identifiable light emitting device circuit 11 is to set the equivalent impedance of the identifiable light emitting device circuit 11. If the identifiable light emitting device circuit 11 has only the LED circuit 10 without the passive device circuit 111, the identifiable light emitting device circuit 11 does not have an impedance which is certain, and it will be difficult to set the aforementioned reference level Vref2 (or the reference levels Vref2 and vref3).

Figure 7:
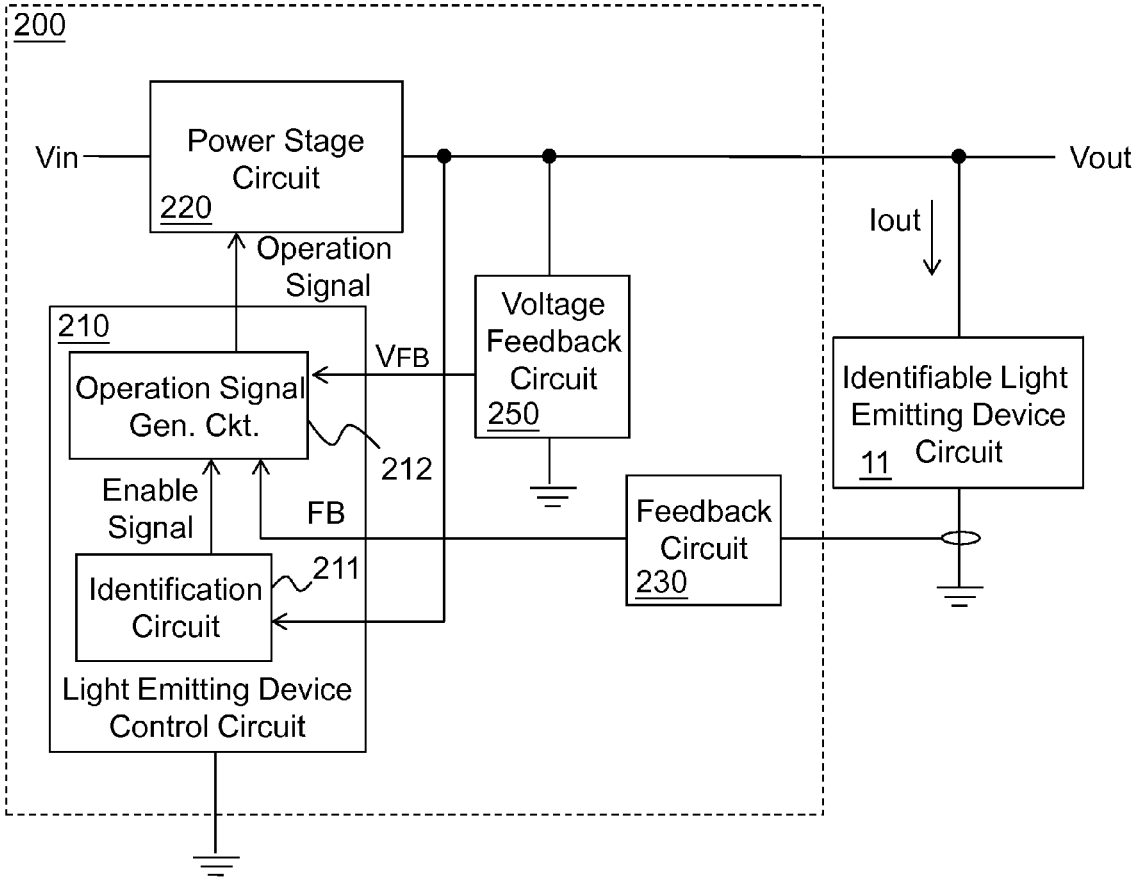
FIG. 7 shows a second embodiment of the present invention.

FIG. 7 shows a second embodiment of the present invention. The first embodiment shows one of the protection methods. In the first embodiment shown in FIG. 3, when the identifiable light emitting device circuit 11 is removed, the level control circuit 240 controls the output voltage Vout. The second embodiment shows another protection method. In the second embodiment, the light emitting device power supply circuit 200 includes the light emitting device control circuit 210, the power stage circuit 220, the feedback circuit 230, and a voltage feedback circuit 250. In the identified mode, when the identification circuit 211 determines that an identifiable light emitting device circuit 211 which complies with the required specification is coupled to the power stage circuit 220, the enable signal outputted from the identification circuit 211 enables the operation signal generation circuit 212 to generate the operation signal according to the feedback signal FB, whereby the circuitry operates in a current control mode to supply the output current Iout to the identifiable light emitting device circuit 11. In the miss mode, for example when the identification circuit 211 determines that there is not any identifiable light emitting device circuit 211 which complies with the required specification being coupled to the power stage circuit 220, the enable signal outputted from the identification circuit 211 enables the operation signal generation circuit 212 to generate the operation signal according to the voltage feedback signal VFB, whereby the circuitry operates in a voltage control mode to regulate the output voltage Vout at a safe predetermined level.

Note that, in the present invention, the miss mode may indicate various conditions, such as: that the identifiable light emitting device circuit 11 is not coupled to the power stage circuit 220; or that a light emitting device circuit not complying with the required specification is installed and coupled to the power stage circuit 220. Or, the miss mode may indicate that the light emitting device control circuit 210 or the power stage circuit 220 is OFF or malfunctions (this can be considered as a condition of the miss mode), or that an electric device of the identifiable light emitting device circuit 11 is damaged to cause a change of the equivalent impedance. In view of the foregoing, the miss mode can be set as required to cover various conditions, which is, in a broad sense, that the identifiable light emitting device circuit 11 is not normally coupled.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention. For example, a device or circuit which does not substantially influence the primary function of a signal can be inserted between any two devices or circuits shown to be in direct connection in the embodiments, such as a switch or the like, so the term "couple" should include direct and indirect connections. For another example, the light emitting device that is applicable to the present invention is not limited to the LED as shown and described in the embodiments above, but may be any current-control device. For another example, the meanings of the high and low levels of a digital signal are interchangeable, with corresponding amendments of the circuits processing these signals. For another example, the positive and negative input terminals of the comparison circuits (comparators or operational amplifiers) are interchangeable, with corresponding amendments of the circuits processing these signals. For another example, that the identifiable light emitting device circuit is coupled to the power stage circuit is not limited to a direct connection between the identifiable light emitting device circuit and the output node of the power stage circuit, but may be an indirect connection condition (with another circuit inserted in between). For another example, the predetermined condition which is that the output voltage Vout is lower than the reference level Vref2, may be modified as "that the output voltage Vout is higher than a predetermined reference level". In view of the foregoing, the spirit of the present invention should cover all such and other modifications and variations, which should be interpreted to fall within the scope of the following claims and their equivalents.

What is claimed is:

1. A light emitting device power supply circuit, for identifying an identifiable light emitting device circuit to determine whether to operate in an identified mode or a miss mode and supply an output current to the identifiable light emitting device circuit in the identified mode, wherein the identified mode indicates that the identifiable light emitting device circuit is normally coupled to the light emitting device power supply circuit, and the miss mode indicates that the identifiable light emitting device circuit is not normally coupled to the light emitting device power supply circuit, the light emitting device power supply circuit comprising:

a power stage circuit, for operating at least one power switch therein according to an operation signal in the identified mode, to convert an input voltage to an output voltage, and supply the output current to the identifiable light emitting device circuit;

a level control circuit, for controlling the output voltage at a predetermined level in the miss mode;

an identification circuit, for determining whether the miss mode is changed to the identified mode according to whether the output voltage meets a predetermined condition, and generating an enable signal correspondingly; and an operation signal generation circuit, for generating the operation signal according to a feedback signal when the enable signal indicates the identified mode;

wherein the identification circuit includes:

a first comparison circuit, for generating a first comparison signal according to the output voltage and a first reference level, wherein the first reference level is higher than the predetermined level;

a second comparison circuit, for generating a second comparison signal according to the output voltage and a second reference level, wherein the second reference level is lower than the predetermined level; and a determination circuit, which is coupled to the first comparison circuit and the second comparison circuit, and outputs the enable signal, wherein the determination circuit determines a level of the enable signal according to the first comparison signal and/or the second comparison signal.

2. The light emitting device power supply circuit of claim 1, wherein the identification circuit generates the enable signal after a delay time period from when the output voltage meets the predetermined condition.

3. The light emitting device power supply circuit of claim 1, wherein the level control circuit includes a voltage divider circuit, the voltage divider circuit including a first bias circuit and a second bias circuit connected in series, wherein a connection node between the first bias circuit and the second bias circuit is electrically connected to the output voltage.

4. The light emitting device power supply circuit of claim 3, wherein a level of the output voltage changes while the identifiable light emitting device circuit changes from being not normally coupled to being normally coupled.

5. The light emitting device power supply circuit of claim 1, wherein the predetermined condition is: the output voltage being lower than a reference level, and the reference level being lower than the predetermined level.

6. A light emitting device control circuit, for identifying an identifiable light emitting device circuit to determine whether to operate in an identified mode or a miss mode, the light emitting device control circuit comprising:

an operation signal generation circuit, for generating an operation signal according to a feedback signal in the identified mode to operate at least one power switch in a power stage circuit, such that an input voltage is converted to an output voltage and an output current is supplied to the identifiable light emitting device circuit; and an identification circuit, which is coupled to the operation signal generation circuit, for determining whether the miss mode is changed to the identified mode according to whether the output voltage meets a predetermined condition, and correspondingly generating an enable signal which is sent to the operation signal generation circuit, such that the light emitting device control circuit operates in the identified mode;

wherein the identified mode indicates that the identifiable light emitting device circuit is normally coupled to the light emitting device power supply circuit, and the miss mode indicates that the identifiable light emitting device circuit is not normally coupled to the light emitting device power supply circuit, and wherein the output voltage is controlled at a predetermined level in the miss mode;

wherein the identification circuit includes:

a first comparison circuit, for generating a first comparison signal according to the output voltage and a first reference level, wherein the first reference level is higher than the predetermined level;

a second comparison circuit, for generating a second comparison signal according to the output voltage and a second reference level, wherein the second reference level is lower than the predetermined level; and a determination circuit, which is coupled to the first comparison circuit and the second comparison circuit, and outputs the enable signal, wherein the determination circuit determines a level of the enable signal according to the first comparison signal and/or the second comparison signal.

7. The light emitting device control circuit of claim 6, wherein the identification circuit generates the enable signal after a delay time period from when the output voltage meets the predetermined condition.

8. The light emitting device control circuit of claim 6, wherein a level of the output voltage changes while the identifiable light emitting device circuit changes from being not normally coupled to being normally coupled.

9. The light emitting device control circuit of claim 6, wherein the predetermined condition is: the output voltage being lower than a reference level, and the reference level being lower than the predetermined level.

10. The light emitting device control circuit of claim 6, wherein the power stage circuit is coupled to a level control circuit which includes a voltage divider circuit, the voltage divider circuit including a first bias circuit and a second bias circuit connected in series, wherein a connection node between the first bias circuit and the second bias circuit is electrically connected to the output voltage.

11. An identifiable light emitting device circuit for a light emitting device control circuit, wherein the light emitting device control circuit is for identifying the identifiable light emitting device circuit to determine whether to operate in an identified mode or a miss mode, such that in the identified mode, the light emitting device control circuit operates at least one power switch in a power stage circuit to convert an input voltage to an output voltage and supply an output current to the identifiable light emitting device circuit, and in the miss mode, the output voltage is controlled at a predetermined level, wherein the identified mode indicates that the identifiable light emitting device circuit is normally coupled to the light emitting device power supply circuit, and the miss mode indicates that the identifiable light emitting device circuit is not normally coupled to the light emitting device power supply circuit, the identifiable light emitting device circuit comprising:

at least one light emitting device, for coupling to the power stage circuit and lighting by receiving the output current in the identified mode; and a passive device circuit, which is coupled to the light emitting device, for providing an impedance such that the output voltage is changed when the miss mode is changed to the identified mode, whereby the light emitting device control circuit determines that the identifiable light emitting device circuit is normally coupled to the light emitting device power supply circuit.

12. An identification method of identifying an identifiable light emitting device circuit, comprising:

controlling an output voltage at a predetermined level when the identifiable light emitting device circuit is not normally coupled to the output voltage;

providing an impedance in the identifiable light emitting device circuit;

setting the output voltage to a predetermined condition by the impedance in the identifiable light emitting device circuit when the identifiable light emitting device circuit changes from being not normally coupled to being normally coupled to the output voltage;

determining whether the identifiable light emitting device circuit changes from being not normally coupled to being normally coupled according to whether the output voltage meets the predetermined condition; and determining that the identifiable light emitting device circuit changes from being normally coupled to being not normally coupled when the output voltage is lower than a first reference level, wherein the first reference level is higher than the predetermined level;

wherein the predetermined condition is: the output voltage being lower than a second reference level, and the second reference level being lower than the predetermined level.

13. The identification method of claim 12, further comprising: delaying a delay time period after determining the identifiable light emitting device circuit changing from being not normally coupled to being normally coupled, and after the delay time period, enabling a power stage circuit to supply an output current to the identifiable light emitting device circuit.

14. An identification method of identifying an identifiable light emitting device circuit, comprising:

controlling an output voltage at a predetermined level when the identifiable light emitting device circuit is not normally coupled to the output voltage;

providing an impedance in the identifiable light emitting device circuit;

setting the output voltage to a predetermined condition by the impedance in the identifiable light emitting device circuit when the identifiable light emitting device circuit changes from being not normally coupled to being normally coupled to the output voltage;

determining whether the identifiable light emitting device circuit changes from being not normally coupled to being normally coupled according to whether the output voltage meets the predetermined condition;

wherein the step of controlling an output voltage at a predetermined level when the identifiable light emitting device circuit is not normally coupled to the output voltage includes: providing a voltage divider circuit which generates a divided voltage according to a supply voltage, and providing the divided voltage as the output voltage;

wherein when the identifiable light emitting device circuit changes from being not normally coupled to being normally coupled, the impedance in the identifiable light emitting device circuit changes the divided voltage of the voltage divider circuit, such that the output voltage meets the predetermined condition.

* * * * *